US011512911B2

(12) United States Patent
Wei et al.

(10) Patent No.: US 11,512,911 B2
(45) Date of Patent: Nov. 29, 2022

(54) HEAT EXCHANGER FLAT TUBE AND HEAT EXCHANGER WITH HEAT EXCHANGER FLAT TUBE

(71) Applicant: ZHEJIANG DUNAN ARTIFICIAL ENVIRONMENT CO., LTD., Zhejiang (CN)

(72) Inventors: Wenjian Wei, Zhejiang (CN); Wenyong Ma, Zhejiang (CN)

(73) Assignee: ZHEJIANG DUNAN ARTIFICIAL ENVIRONMENT CO., LTD., Zhejiang (CN)

( * ) Notice: Subject to any disclaimer, the term of this patent is extended or adjusted under 35 U.S.C. 154(b) by 0 days.

(21) Appl. No.: 17/057,115

(22) PCT Filed: Sep. 4, 2019

(86) PCT No.: PCT/CN2019/104430
§ 371 (c)(1),
(2) Date: Nov. 20, 2020

(87) PCT Pub. No.: WO2020/052485
PCT Pub. Date: Mar. 19, 2020

(65) Prior Publication Data

US 2021/0215443 A1 Jul. 15, 2021

(30) Foreign Application Priority Data

Sep. 10, 2018 (CN) ..... 201811052237.9

(51) Int. Cl.
*F28F 13/12* (2006.01)
*F28F 1/42* (2006.01)
*F28F 3/02* (2006.01)

(52) U.S. Cl.
CPC ..... *F28F 13/12* (2013.01); *F28F 1/426* (2013.01); *F28F 3/025* (2013.01); *F28F 2275/04* (2013.01)

(58) Field of Classification Search
CPC ..... F28F 3/025; F28F 2275/04; F28F 1/426; F28F 1/10; F28F 13/12; F28F 3/044; F28F 2001/027
See application file for complete search history.

(56) References Cited

U.S. PATENT DOCUMENTS 5,560,425 A * 10/1996 Sugawara ..... F28D 1/0391 165/173
5,996,633 A * 12/1999 Kato ..... F28F 3/042 138/116

(Continued)

FOREIGN PATENT DOCUMENTS

CN 101050925 A 10/2007
CN 101788240 A 7/2010

(Continued)

*Primary Examiner* — Tho V Duong
(74) *Attorney, Agent, or Firm* — Gang Yu

(57) ABSTRACT

The present disclosure provides a heat exchanger flat tube and a heat exchanger with the heat exchanger flat tube, the heat exchanger flat tube includes two plates opposite to each other, a fluid passage is formed between the two plates, a turbulence structure is provided in the fluid passage and has a gradually expanding portion and a gradually narrowing portion, both an extension direction of the gradually expanding portion and an extension direction of the gradually narrowing portion are consistent with a flow direction of a fluid, and the gradually narrowing portion is located downstream of the gradually expanding portion along the flow direction of the fluid.

17 Claims, 8 Drawing Sheets

(56) References Cited

U.S. PATENT DOCUMENTS

| | | | | |
|---|---|---|---|---|
| 6,453,989 | B1 * | 9/2002 | Watanabe | F28F 3/04 165/177 |
| 6,595,273 | B2 * | 7/2003 | Shimoya | F28F 3/042 165/173 |
| 6,945,320 | B2 * | 9/2005 | Harvard, Jr. | F24H 3/087 165/177 |
| 8,459,342 | B2 * | 6/2013 | O'Donnell | F28F 13/08 165/177 |
| 10,274,261 | B2 * | 4/2019 | Wei | F28F 3/042 |
| 10,520,261 | B2 * | 12/2019 | Brunner | F28F 1/04 |

FOREIGN PATENT DOCUMENTS

| | | | | |
|---|---|---|---|---|
| CN | 103743281 | A | | 4/2014 |
| CN | 205243621 | U | | 5/2016 |
| CN | 205561602 | U | | 9/2016 |
| CN | 107036479 | A | | 8/2017 |
| CN | 107036480 | A | | 8/2017 |
| CN | 107687780 | A | | 2/2018 |
| CN | 207348982 | U | | 5/2018 |
| CN | 207528109 | U | | 6/2018 |
| FR | 741539 | A | * | 2/1933 |
| JP | S6317393 | A | | 1/1988 |
| JP | 11337276 | A | | 12/1999 |
| JP | 2004347159 | A | | 12/2004 |
| KR | 20090008794 | A | | 1/2009 |

* cited by examiner

HEAT EXCHANGER FLAT TUBE AND HEAT EXCHANGER WITH HEAT EXCHANGER FLAT TUBE

CROSS REFERENCE TO RELATED APPLICATION(S)

The present disclosure is a national stage application of International Patent Application No. PCT/CN2019/104430, which is filed on Sep. 4, 2019 and claims priority to Chinese Patent Priority No. 201811052237.9, filed to the National Intellectual Property Administration, PRC on Sep. 10, 2018, entitled "Heat Exchanger Flat Tube and Heat Exchanger with Heat Exchanger Flat Tube", the disclosure of which is hereby incorporated by reference in its entirety.

TECHNICAL FIELD

The present disclosure relates to the technical field of refrigeration air conditioners, and in particular, to a heat exchanger flat tube and a heat exchanger with the heat exchanger flat tube.

BACKGROUND

Currently, a convex hull structure is provided in a heat exchanger flat tube in an art known to inventors, and the convex hull structure may have a certain turbulence effect to a fluid medium in the flat tube. However, the convex hull structure in the art is mainly a circular convex hull structure, and the circular convex hull structure has a limited turbulence effect and cannot well improve the heat exchange efficiency of the heat exchanger flat tube.

SUMMARY

An embodiment of the present disclosure provides a heat exchanger flat tube and a heat exchanger with the heat exchanger flat tube, so as to solve the technical problem in the art known to the inventors that the heat exchange efficiency of the heat exchanger flat tube is not high.

According to an embodiment of the present disclosure, a heat exchanger flat tube is provided, the heat exchanger flat tube includes two plates opposite to each other, a fluid passage is formed between the two plates, a turbulence structure is provided in the fluid passage and has a gradually expanding portion and a gradually narrowing portion, both an extension direction of the gradually expanding portion and an extension direction of the gradually narrowing portion are consistent with a flow direction of a fluid, and the gradually narrowing portion is located downstream of the gradually expanding portion along the flow direction of the fluid.

In an embodiment, the turbulence structure includes a convex hull, and the at least one of the two plates is provided with the convex hull.

In an embodiment, the convex hull includes a first curved surface, a second curved surface, and a third curved surface, wherein the first curved surface and the second curved surface form the gradually expanding portion, and the third curved surface forms the gradually narrowing portion.

In an embodiment, the first curved surface and the second curved surface both protrude towards an inner side direction of the convex hull.

In an embodiment, the third curved surface protrudes towards an outer side direction of the convex hull.

In an embodiment, the first curved surface and the second curved surface are in a circular arc transition; and/or the second curved surface and the third curved surface are in a circular arc transition; and/or, the third curved surface and the first curved surface are in a circular arc transition.

In an embodiment, a length of the convex hull is La along the flowing direction of the fluid; and a width of the convex hull is Lb along a flowing direction perpendicular to the fluid, wherein the value of Lb/La is in a range of 0.7 to 3.73.

In an embodiment, at least one of the two plates is provided with a plurality of convex hulls.

In an embodiment, the plurality of convex hulls are arranged on the at least one of the two plates in an array.

In an embodiment, a transverse spacing of the convex hulls is Lv, a longitudinal spacing of the convex hulls is Lh, along the gas flow direction in the heat exchanger flat tube, a distance between two adjacent convex hulls in the plurality of the convex hulls is the longitudinal spacing and a distance between two adjacent convex hulls in the plurality of the convex hulls is the transverse spacing along a direction perpendicular to the gas flow in the heat exchanger flat tube, wherein a value of Lv/Lh is in a range of 0.7 to 3.73.

In an embodiment, each of the plurality of convex hulls has an incoming flow pressure angle θ, the first curved surface and a plane where the plate is located have a first intersection line, the second curved surface and the plane where the plate is located have a second intersection line, the first intersection line and the second intersection line intersect at a first point, an endpoint of the first intersection line away from the first point is a second point, an endpoint of the second intersection line away from the first point is a third point, and an included angle between a straight line where the first point and the second point are located and a straight line where the first point and the third point are located is the incoming flow pressure angle θ, wherein $\theta=2\arctan Lv/Lh$.

In an embodiment, a height of the convex hull is d, a value of d is in a range of 0.5 mm to 1.2 mm.

In an embodiment, a thickness t of each of the two plates is in a range of 0.3 mm to 1.0 mm.

In an embodiment, the convex hull has a top surface in a direction perpendicular to the flow direction of the fluid, and the top surface is circular or oval.

According to an embodiment of the present disclosure, provided is a heat exchanger including the heat exchanger flat tube provided above.

By applying the technical solution of some embodiments of the present disclosure, a turbulence structure is provided in a fluid passage, the turbulence structure has a gradually expanding portion and a gradually narrowing portion in the flow direction of a fluid, and when flowing in the flow passage, a fluid medium passes through the gradually expanding portion first and then passes through the gradually narrowing portion, such that a speed of the fluid medium is increased, thereby increasing the turbulence of the fluid medium in the fluid passage, and facilitating further improvement of the heat exchange effect. Meanwhile, such an arrangement increases a shearing force of the fluid and the turbulence structure, so that a thickness of a flow boundary layer and a thickness of a thermal boundary layer are reduced, and a convective heat-transfer coefficient is increased. Therefore, by means of the heat exchanger flat tube provided in some embodiments of the present disclosure, the technical problem that the heat exchange efficiency of the heat exchanger flat tubes in the art known to the inventors is low can be solved.

BRIEF DESCRIPTION OF THE DRAWINGS

The drawings, which constitute a part of the description, are intended to provide better understanding of the present disclosure, and the exemplary embodiments of the present disclosure and their description aim to only illustrate the present disclosure but not to limit the present disclosure. In the drawings.

Figure 1:
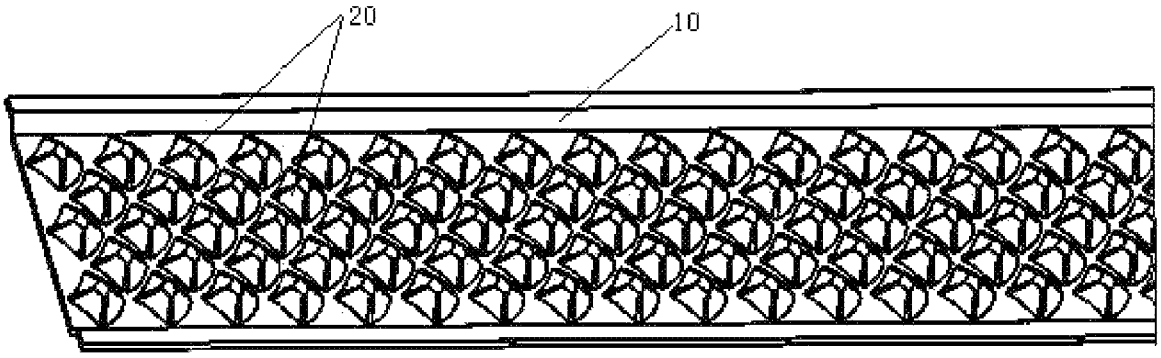
FIG. 1 shows a schematic structural view of a plate according to embodiment 1 of the present disclosure.
Figure 2:
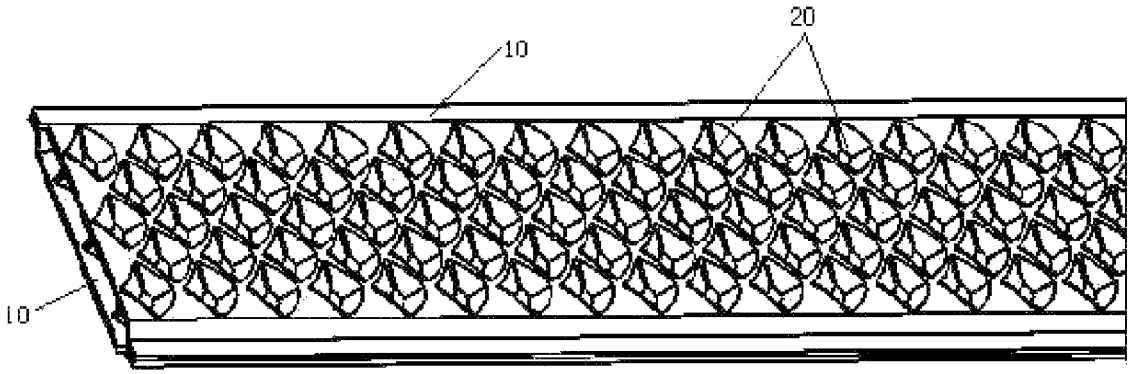
FIG. 2 shows a partial schematic structural view of a heat exchanger flat tube according to embodiment 1 of the present disclosure.
Figure 3:
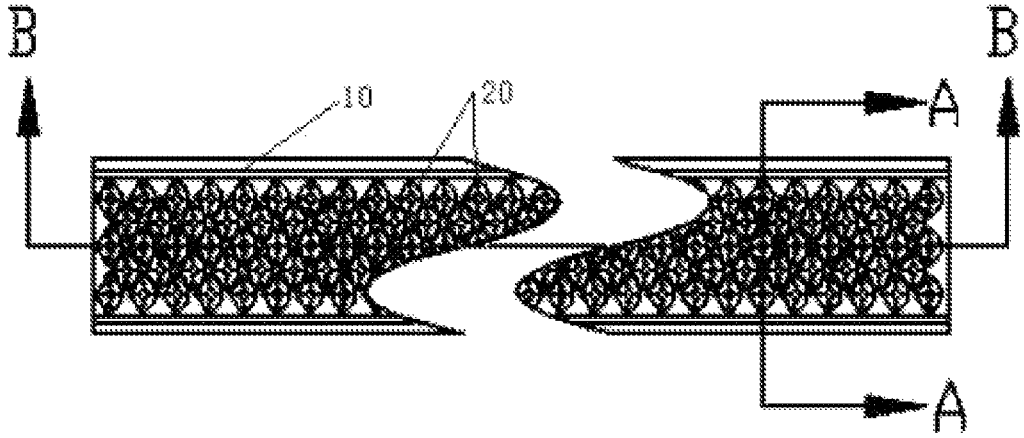
FIG. 3 shows a schematic structural view of a heat exchanger flat tube according to embodiment 1 of the present disclosure.
Figure 4:
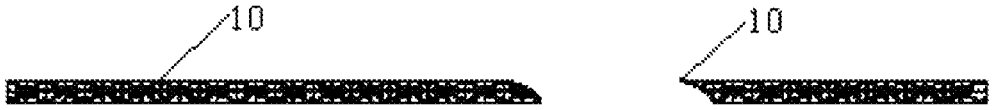
FIG. 4 shows a sectional view of the cross section B-B in FIG. 3.
Figure 5:
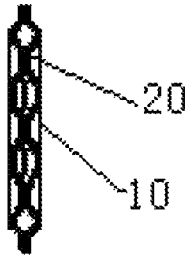
FIG. 5 shows a sectional view of the cross section A-A in FIG. 3.
Figure 6:
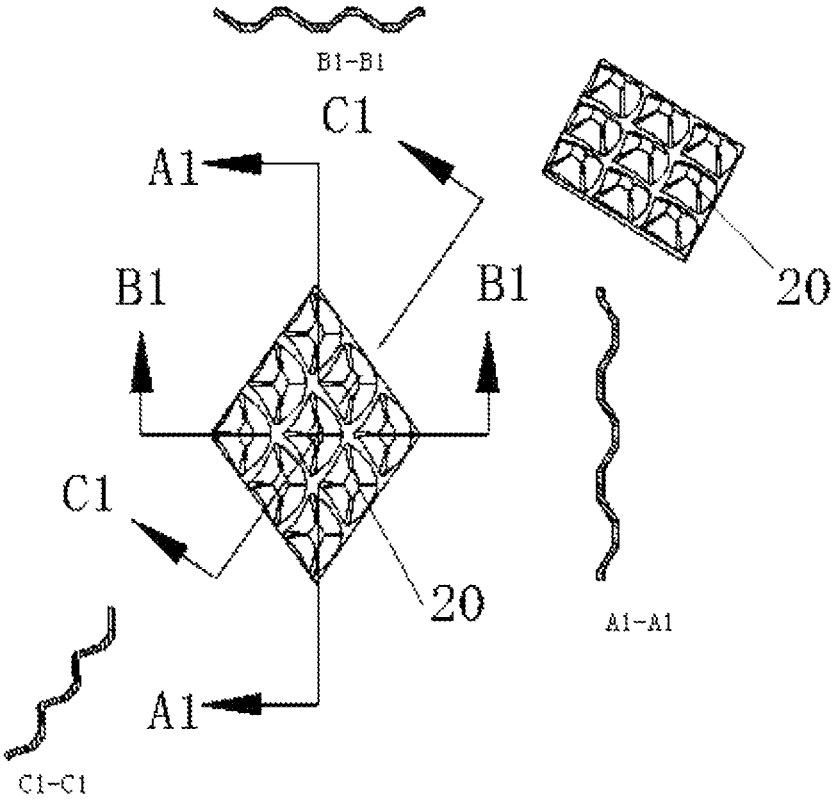
FIG. 6 shows sectional views of the plate along the cross sections A1-A1, B1-B1 and C1-C1.
Figure 7:
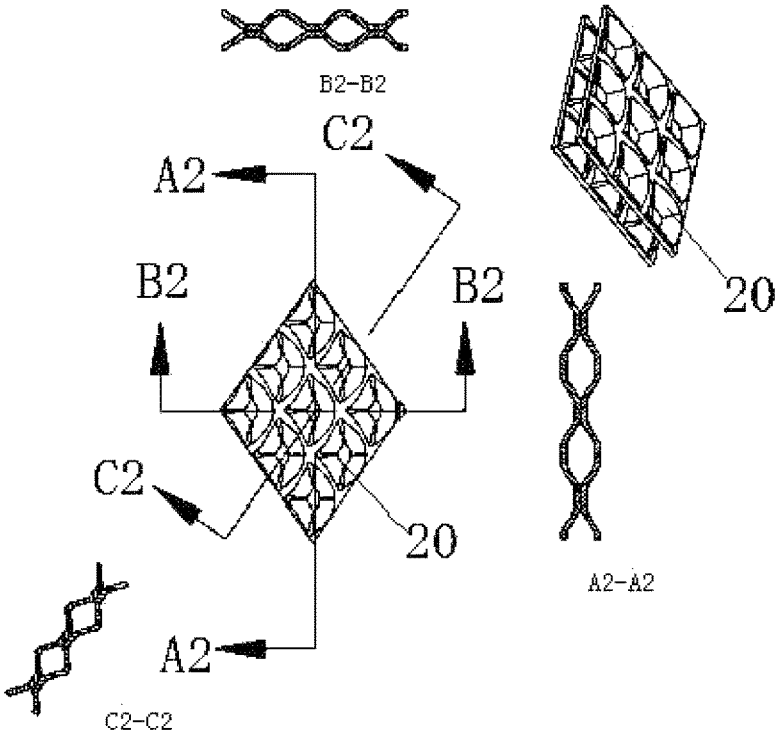
FIG. 7 shows sectional views of the heat exchanger flat tube along the cross sections A2-A2, B2-B2 and C2-C2.

The drawings include the following reference signs:

10, plate; 20, convex hull; 30, heat exchanger flat tube; 40, collecting tube

DETAILED DESCRIPTION OF THE EMBODIMENTS

Hereinafter, the technical solutions in the embodiments of the present disclosure are described clearly and fully with reference to the attached drawings in the embodiments of the present disclosure. Obviously, the embodiments as described are only parts of embodiments rather than all the possible embodiments thereof. The following description of at least one exemplary embodiment is merely exemplary in nature and is in no way intended to limit the disclosure, its application, or uses. All embodiments obtained by an ordinary person skilled in the art without involving inventive work based on the embodiments of the present disclosure fall into the scope of protection of the present disclosure.

As shown in FIGS. 1 to 16, embodiment I of the present disclosure provides a heat exchanger flat tube, the heat exchanger flat tube includes two plates 10 opposite to each other, a fluid passage is formed between the two plates 10, a turbulence structure is provided in the fluid passage and has a gradually expanding portion and a gradually narrowing portion, both an extension direction of the gradually expanding portion and an extension direction of the gradually narrowing portion are consistent with a flow direction of a fluid, and the gradually narrowing portion is located downstream of the gradually expanding portion along the flow direction of the fluid.

A turbulence structure is provided in a fluid passage, the turbulence structure has a gradually expanding portion and a gradually narrowing portion in the flow direction of the fluid, and when flowing in the flow passage, a fluid medium passes through the gradually expanding portion first and then passes through the gradually narrowing portion, such that a speed of the fluid medium is increased, thereby increasing the turbulence of the fluid medium in the fluid passage, and facilitating further improvement of the heat exchange effect. Meanwhile, such an arrangement increases a shearing force of the fluid and the turbulence structure, so that a thickness of a flow boundary layer and a thickness of a thermal boundary layer are reduced, and a convective heat-transfer coefficient is increased. Therefore, by means of the heat exchanger flat tube provided in some embodiments of the present disclosure, the technical problem that the heat exchange efficiency of the heat exchanger flat tubes in the art known to inventors is low can be solved.

Specifically, the turbulence structure in an embodiment includes a convex hull 20, the convex hull 20 is provided on at least one plate 10, and the fluid in the fluid passage is disturbed by the convex hull 20 on the plate 10, In this embodiment, both of the two plates 10 are provided with the convex hull 20 to further improve the effect of turbulence in the fluid passage, so as to further improve the heat exchange efficiency.

Figure 8:
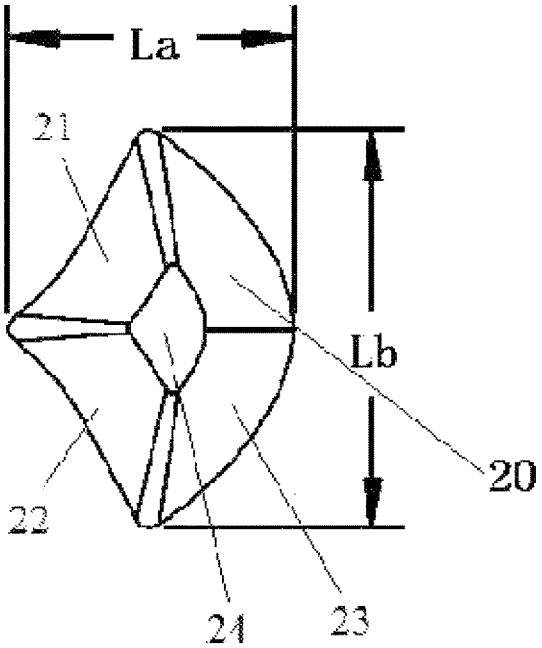
FIG. 8 shows the length and width of a single convex hull.

As shown in FIG. 8, In an embodiment, the convex hull 20 includes a first curved surface 21, a second curved surface 22, and a third curved surface 23, wherein the first curved surface 21 and the second curved surface 22 form the gradually expanding portion, and the third curved surface 23 forms the gradually narrowing portion. In an embodiment, the convex hull 20 further includes a top surface 24, wherein the first curved surface 21 is connected with the second curved surface 22; the second curved surface 22 is connected with the third curved surface 23; the third curved surface 23 is connected with the first curved surface 21; the first curved surface 21, the second curved surface 22 and the third curved surface 23 are all connected with the top surface 24; and the first curved surface 21, the second curved surface 22, the third curved surface 23 and the top surface 24 enclose the convex hull 20 in this embodiment. The fluid in the fluid passage sequentially passes through the gradually expanding portion formed by the first curved surface and the second curved surface and the gradually narrowing portion formed by the third curved surface, so as to increase the disturbance effect of the fluid in the fluid passage, and better improve the heat exchange efficiency. With such an arrangement, the shearing force between the fluid and a wall surface of the convex hull 20 is increased, so that the thickness of the flow boundary layer and the thickness of the thermal boundary layer are reduced, and the convective heat-transfer coefficient is increased. The convex hull 20 in the embodiment has a simple structure and a remarkable effect, and is convenient for production and manufacture.

Figure 11:
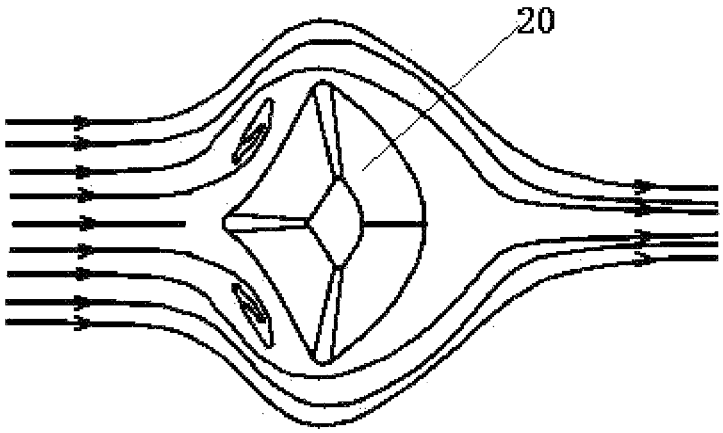
FIG. 11 shows a schematic view of a flow surrounding a convex hull for turbulence.
Figure 12:
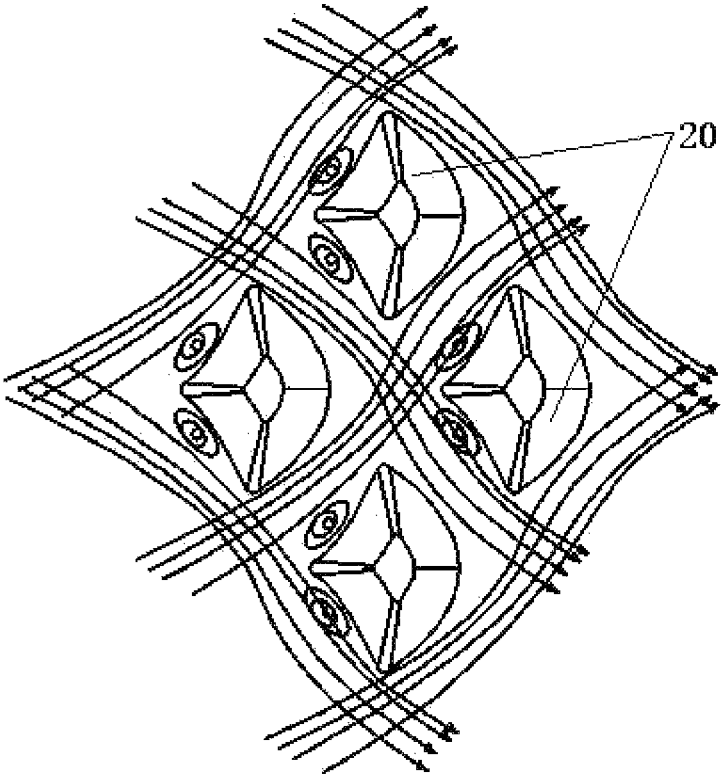
FIG. 12 shows a schematic view of a flow surrounding a plurality of convex hulls for turbulence.
Figure 13:
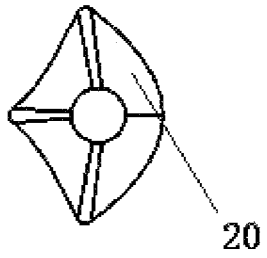
FIG. 13 shows a schematic structural view of a convex, hull with a circular top surface.
Figure 14:
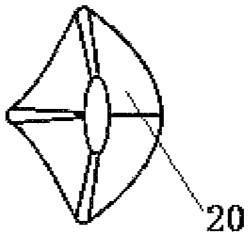
FIG. 14 shows a schematic structural view of a convex hull with an oval top.
Figure 15:
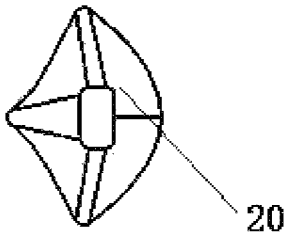
FIG. 15 shows a schematic structural view of a rectangular convex hull with a rounded-off rectangular top surface.
Figure 16:
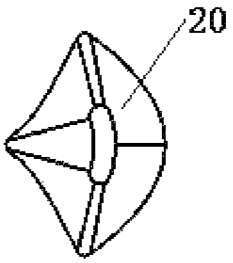
FIG. 16 shows a schematic structural view of a convex hull with a waist-shaped top surface.
Figure 17:
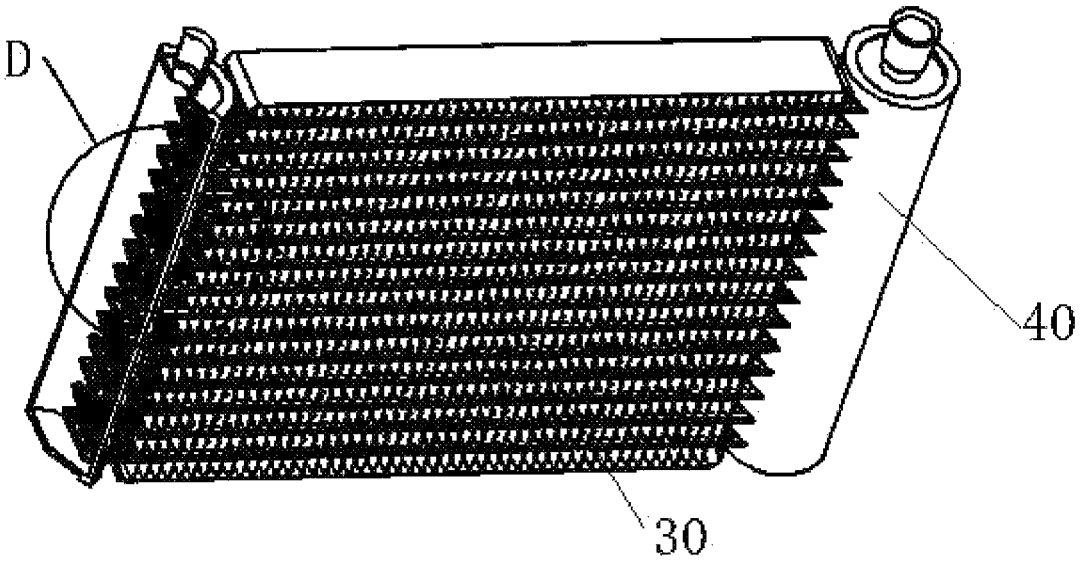
FIG. 17 shows a schematic structural view of a heat exchanger provided in embodiment 2 of the present disclosure.
Figure 18:
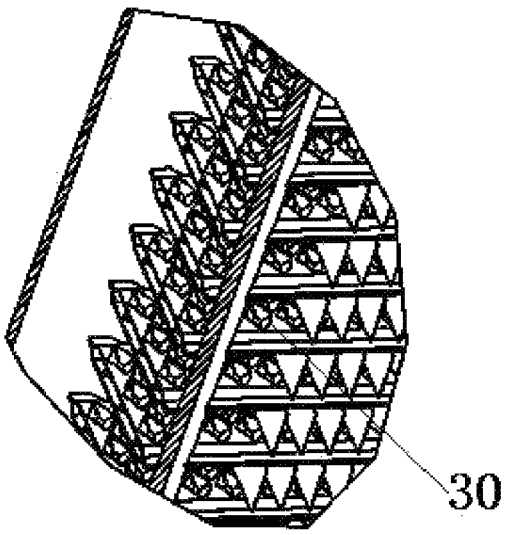
FIG. 18 shows an amplified schematic view of portion D in FIG. 17.
Figure 19:
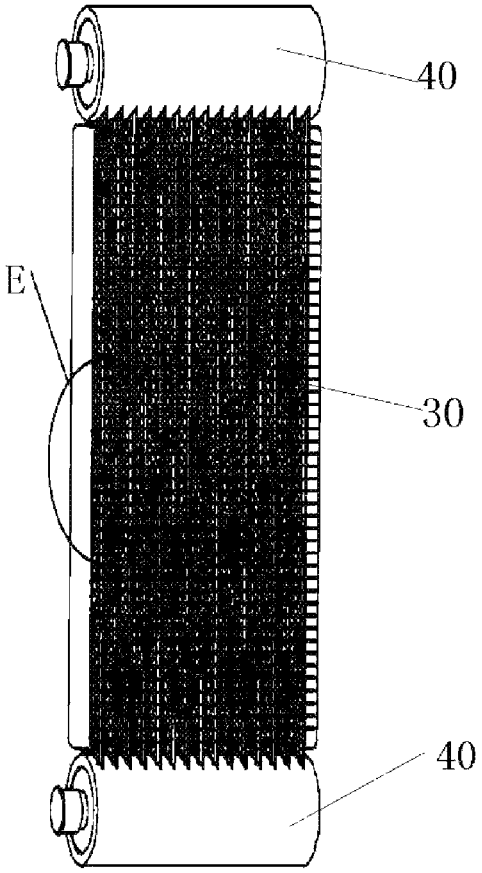
FIG. 19 shows a side view of a heat exchanger provided in embodiment 2 of the present disclosure.
Figure 20:
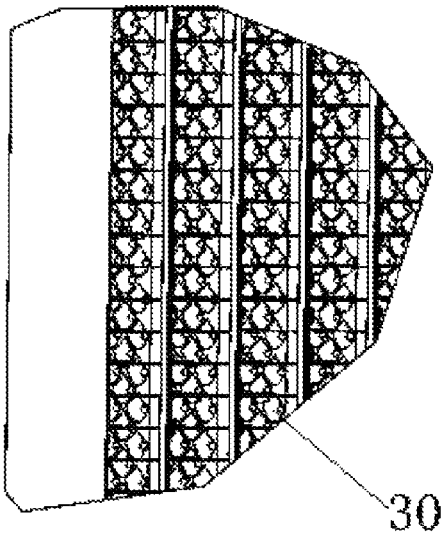
FIG. 20 shows an amplified schematic view of portion E in FIG. 19.

As shown in FIGS. 11 and 12, in order to further improve the heat exchange effect, in the embodiment, both the first curved surface and the second curved surface protrude towards an inner side direction of the convex hull 20. With such an arrangement, when the fluid flows through the first curved surface and the second curved surface, a certain turbulence occurs, so as to strengthen the heat exchange effect.

In order to better improve the heat exchange effect, in an embodiment, the third curved surface protrudes towards an outer side direction of the convex hull 20.

In an embodiment, the first curved surface and the second curved surface are in a circular arc transition; or the second curved surface and the third curved surface are in a circular arc transition; or the third curved surface and the first curved surface are in a circular arc transition; or the first curved surface and the second curved surface are in a circular arc transition, and the second curved surface and the third curved surface are in a circular arc transition; the first curved surface and the second curved surface are in a circular arc transition, and the third curved surface and the first curved surface are in a circular arc transition; or the second curved surface and the third curved surface are in a circular arc transition, and the first curved surface and the third curved surface are in a circular arc transition; or the first curved surface, the second curved surface and the third curved surface are all are in a circular arc transition.

In an embodiment, the first curved surface, the second curved surface, and the third curved surface are all are in a circular arc transition, so as to facilitate the flow of the fluid in the fluid passage.

As shown in FIG. 8, a length of the convex hull is La in a flowing direction of the fluid; and a width of the convex hull is Lb in a flowing direction perpendicular to the fluid, wherein the value of Lb/La is in a range of 0.7 to 3.73. Within this range of value, the effects of heat exchange and pressure drop is better.

In order to further improve the heat exchange effect, a plurality of convex hulls 20 are provided on the plate 10 in the embodiment. Thus, the arrangement of the convex hulls 20 is more reasonable and compact.

In an embodiment, a plurality of convex, hulls 20 are arranged on the at least one plate 10 of the two plates in an array. The fluid in the fluid passage passes through the convex hulls 20 arranged in an array, which further improves the turbulence effect, facilitate convective heat exchange, and better improve the heat exchange effect.

Figure 9:
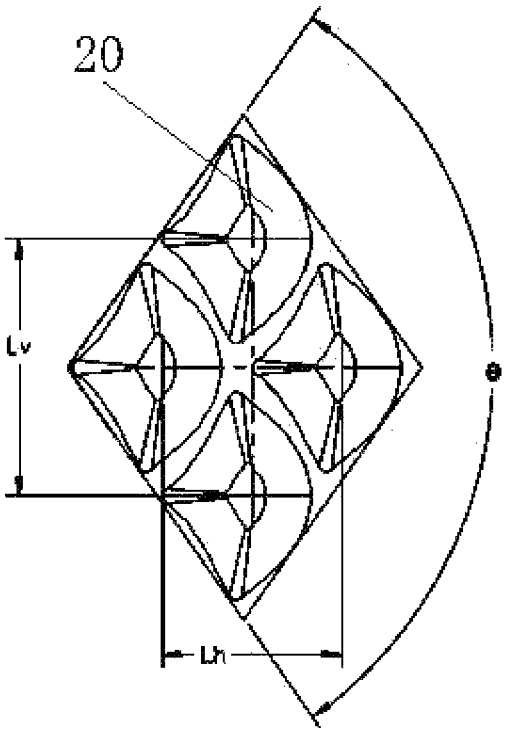
FIG. 9 shows the transverse spacing, longitudinal spacing and incoming flow pressure angle θ of the convex hull.

As shown in FIG. 9, in this embodiment, a transverse spacing of the convex hulls 20 is Lv, a longitudinal spacing of the convex hulls 20 is Lh, a distance between two adjacent convex hulls 20 in the plurality of the convex hulls is the longitudinal spacing in the gas flow direction in the heat exchanger flat tube, and a distance between two adjacent convex hulls 20 in the plurality of the convex hulls is the transverse spacing in a direction perpendicular to the gas flow in the heat exchanger flat tube, wherein the value of Lv/Lh is in a range of 0.7 to 3.73. By means of such an arrangement, the arrangement of the convex hull 20 are more compact, the clearance is reduced, and gas-liquid separation caused by gas-phase bypass is improved in a two-phase flow working condition.

As shown in FIG. 9, the convex hull 20 has an incoming flow pressure angle θ, the first curved surface and a plane where the plate 10 is located have a first intersection line, the second curved surface and the plane where the plate 10 is located have a second intersection line, the first intersection line and the second intersection line intersect at a first point, an endpoint of the first intersection line away from the first point is a second point, an endpoint of the second intersection line away from the first point is a third point, and an included angle between a straight line where the first point and the second point are located and a straight line where the first point and the third point are located is the incoming flow pressure angle θ, wherein $\theta=2 \arctan Lv/Lh$. By adjusting the incoming flow, pressure angle θ, the heat exchange effect and a pressure-drop coefficient are adjusted. Specifically, the incoming flow pressure angle θ is increased to allow the media to be distributed laterally within the passage, so as to adjust the optimal matching of heat exchange and pressure drop.

Figure 10:
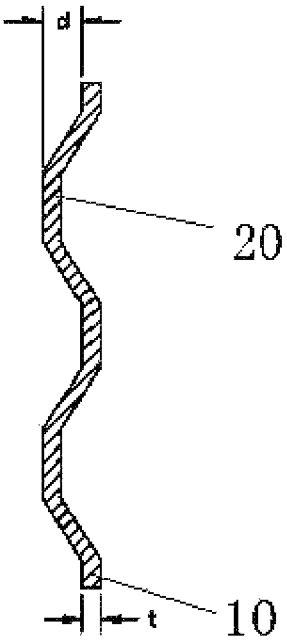
FIG. 10 shows the height of the convex hull and the thickness of the plate.

As shown in FIG. 10, a height of the convex hull is d, the value of d is in a range of 0.5 mm to 1.2 mm. By setting the height of the convex hull 20 to be within this range, the fluid is better scrambled, thereby better improving the heat exchange effect.

As shown in FIG. 10, in an embodiment, in order to ensure the overall structural strength of the plate 10, the value of the thickness t of the plate 10 is within a range of 0.3 mm to 1.0 mm. In an embodiment, the plate 10 is made of an aluminum material or a composite aluminum material, and uses brazing processing technology.

As shown in FIGS. 13 to 16, the convex hull has a top surface in a direction perpendicular to the flow direction of the fluid, and the top surface is circular or oval. In an embodiment, the convex hull 20 may also be in the shape of a rounded off rectangle or waist. Compared with the dot convex hull 20 in an art known to inventors, the arrangement of the convex hulls 20 in this embodiment is more reasonable, the plate 10 has higher utilization rate, small clearance, and more features per unit area, and the welding spot density on the plate 10 is increased, thereby improving the pressure resistance capability.

The convex hull 20 in this embodiment has a structure similar to that of a fish scale, and has the feature of efficient heat exchange. In an embodiment, the convex hull 20 is processed and molded by using a stamping molding process, wherein two sides of the plate 10 are provided with flanges, and the two plates opposite to each other are spliced together by means of the flanges.

As shown in FIGS. 17 to 20, embodiment 2 of the present disclosure provides a heat exchanger including the heat exchanger flat tube 30 provided in embodiment 1. The heat exchanger in the embodiment includes a plurality of parallel heat exchanger flat tubes 30 and two collecting tubes 40 vertically disposed, the plurality of heat exchanger flat tubes 30 are provided between the two collecting tubes, and two ends of each heat exchanger flat tube 30 are in communication with the two collecting tubes. The heat exchange effect is improved by means of the heat exchanger provided in this embodiment.

It should be noted that the terminology used herein is for the purpose of describing particular embodiments only and is not intended to be limiting of exemplary embodiments in accordance with the present application. As used herein, the singular form is intended to include the plural form, unless otherwise noted in the context, and further it should be understood that the terms "comprises" and/or "includes"

when used in this description, specify the presence of features, steps, operations, devices, components, and/or combinations thereof.

The relative arrangement of components and steps, numerical expressions and numerical values set forth in these embodiments are not intended to limit the scope of the present disclosure, unless specifically stated otherwise. Meanwhile, it should be understood that, for the convenience of description, the dimensions of the parts shown in the drawings are not drawn according to the actual proportional relationship. Techniques, methods, and devices known to those of ordinary skill in the relevant art may not be discussed in details, but should be considered as part of the description, where appropriate. In all examples shown and discussed herein, any specific value should be construed as exemplary only and not as limiting. Therefore, other examples of the exemplary embodiments may have different values. It should be noted that similar items are represented with similar reference signs and letters in the following drawings, and thus once an item is defined in a figure, it does not need to be further discussed in subsequent figures.

In the description of the present disclosure, it's to be appreciated that the orientation or positional relationship indicated by the terms "front, rear, upper, lower, left, right", "transverse, longitudinal, vertical, horizontal" and "top, bottom" the like means the orientation or positional relationship illustrated based on the drawings, and is nothing but for the convenience of describing the present disclosure and simplifying the description, rather than teaches or suggests that the indicated device or element have to take the specific orientation, be designed and operated in the specific orientation, unless otherwise specified, and thus cannot be construed as limiting the scope of protection of the present disclosure; and the orientation words "inner, outer" refer to the inside and outside relative to the outline of each component itself.

For ease of description, spatially relative terms, such as "over", "above", "on", "upper" and the like may be used herein to describe spatial positional relationships of one device or feature with other devices or features as illustrated in the drawings. It will be understood that the spatially relative terms are intended to include different orientations in use or operation in addition to the orientation of the device as illustrated in the drawings. For example, if a device in the drawings is inverted, the device described as "above the other devices or structures" or "over the other devices or structures" would then be located to be "below the other devices or structures" or "under the other devices or structures". Accordingly, the exemplary term "above" can include both orientations of "above" and "below". The device may be positioned in various other ways as well (rotated by 90 degrees or at other orientations), and the spatially relative descriptions used herein are to be construed accordingly.

In addition, it should be noted that, terms such as "first" and "second" are used to define parts only for the convenience of distinguishing corresponding parts, and the described terms have no special meanings, unless otherwise specified, and therefore cannot be construed as limiting the scope of protection of the present disclosure.

The embodiments of the present disclosure described above are intended to illustrate but not limit the present disclosure. Any modification, equivalent substitution, and improvement within the spirit and principle of the present disclosure should be covered in the scope of protection of the present disclosure.

What is claimed is:

1. A heat exchanger flat tube, comprising two plates opposite to each other, a fluid passage is formed between the two plates, a turbulence structure is formed in the fluid passage, the turbulence structure has a gradually expanding portion and a gradually narrowing portion, both an extension direction of the gradually expanding portion and an extension direction of the gradually narrowing portion are consistent with a flow direction of a fluid, and the gradually narrowing portion is located downstream of the gradually expanding portion along the flow direction of the fluid;

the turbulence structure comprises a convex hull, and the convex hull is provided on at least one of the two plates;

the convex hull comprises a first curved surface, a second curved surface, and a third curved surface, wherein the first curved surface and the second curved surface form the gradually expanding portion, and the third curved surface forms the gradually narrowing portion;

both the first curved surface and the second curved surface protrude towards an inner side direction of the convex hull.

2. The heat exchanger flat tube as claimed in claim 1, wherein, the third curved surface protrudes towards an outer side direction of the convex hull.

3. The heat exchanger flat tube as claimed in claim 1, wherein, the first curved surface and the second curved surface are in a circular arc transition; and/or, the second curved surface and the third curved surface are in a circular arc transition; and/or, the third curved surface and the first curved surface are in a circular arc transition.

4. The heat exchanger flat tube as claimed in claim 1, wherein, a length of the convex hull is La along the flowing direction of the fluid; and a width of the convex hull is Lb along a flowing direction perpendicular to the fluid, wherein a value of Lb/La is in a range of 0.7 to 3.73.

5. The heat exchanger flat tube as claimed in claim 1, wherein, at least one of the two plates is provided with a plurality of convex hulls.

6. The heat exchanger flat tube as claimed in claim 5, wherein, the plurality of the convex hulls are arranged on the at least one plate of the two plates in an array.

7. The heat exchanger flat tube as claimed in claim 6, wherein, a transverse spacing of the convex hulls is Lv, a longitudinal spacing of the convex hulls is Lh, along a gas flow direction in the heat exchanger flat tube, a distance between two adjacent convex hulls in the plurality of the convex hulls is the longitudinal spacing and along a direction perpendicular to the gas flow in the heat exchanger flat tube, a distance between two adjacent convex hulls in the plurality of the convex hulls is the transverse spacing wherein a value of Lv/Lh is in a range of 0.7 to 3.73.

8. The heat exchanger flat tube as claimed in claim 7, wherein, each of the plurality of convex hulls has an incoming flow pressure angle θ, the first curved surface and a plane where the plate is located have a first intersection line, the second curved surface and the plane where the plate is located have a second intersection line, the first intersection line and the second intersection line intersect at a first point, an endpoint of the first intersection line away from the first point is a second point, an endpoint of the second intersection line away from the first point is a third point, and an included angle between a straight line where the first point and the second point are located and a straight line where the first point and the third point are located is the incoming flow pressure angle θ, wherein θ=2 arctan Lv/Lh.

9. The heat exchanger flat tube as claimed in claim 1, wherein, a height of the convex hull is d, and a value of d is in a range of 0.5 mm to 1.2 mm.

10. The heat exchanger flat tube as claimed in claim 1, wherein, a thickness of each of the two plates is t, and a value of t is in a range of 0.3 mm to 1.0 mm.

11. The heat exchanger flat tube as claimed in claim 1, wherein, the convex hull has a top surface in a direction perpendicular to the flow direction of the fluid, and the top surface is circular or oval.

12. A heat exchanger, comprising the heat exchanger flat tube as claimed in claim 1.

13. The heat exchanger as claimed in claim 12, wherein, the turbulence structure comprises a convex hull, and the convex hull is provided on at least one of the two plates.

14. The heat exchanger as claimed in claim 13, wherein, the convex hull comprises a first curved surface, a second curved surface, and a third curved surface, wherein the first curved surface and the second curved surface form the gradually expanding portion, and the third curved surface forms the gradually narrowing portion.

15. The heat exchanger as claimed in claim 14, wherein, both the first curved surface and the second curved surface protrude towards an inner side direction of the convex hull.

16. The heat exchanger as claimed in claim 14, wherein, the third curved surface protrudes towards an outer side direction of the convex hull.

17. The heat exchanger as claimed in claim 14, wherein, the first curved surface and the second curved surface are in a circular arc transition; and/or, the second curved surface and the third curved surface are in a circular arc transition; and/or, the third curved surface and the first curved surface are in a circular arc transition.

* * * * *